US005968668A

United States Patent [19]

Fukui

[11] Patent Number: 5,968,668

[45] Date of Patent: Oct. 19, 1999

[54] THERMAL TRANSFER RECORDING MEDIUM

[75] Inventor: Takuto Fukui, Osaka, Japan

[73] Assignee: Fujicopian Co., Ltd., Osaka, Japan

[21] Appl. No.: 09/018,745

[22] Filed: Feb. 4, 1998

[51] Int. Cl.[6] ..... B41M 5/20

[52] U.S. Cl. ..... 428/500; 428/195; 428/913; 428/914

[58] Field of Search ..... 428/195, 500, 428/913, 914

[56] References Cited

U.S. PATENT DOCUMENTS 5,312,692 5/1994 Shiraishi ..... 428/500

FOREIGN PATENT DOCUMENTS 0 228 065 A2 7/1987 European Pat. Off. ..... B41M 5/26

0 629 513 A1 12/1994 European Pat. Off. ..... B41M 5/40

*Primary Examiner*—Pamela R. Schwartz

*Attorney, Agent, or Firm*—Fish & Neave

[57] ABSTRACT

A thermal transfer recording medium comprising a foundation, and a release layer, a protective layer and a colored ink layer provided on the foundation in this order, the protective layer comprising an acrylic resin and a diallyl phthalate resin.

6 Claims, No Drawings

THERMAL TRANSFER RECORDING MEDIUM

BACKGROUND OF THE INVENTION

The present invention relates to a thermal transfer recording medium which has excellent transferability and is capable of producing printed images having good scratch resistance, solvent resistance, and the like.

Conventional thermal transfer recording media for producing printed images having good durability include one having a structure wherein a release layer, a protective layer and a colored ink layer are provided on a foundation in this order and the protective layer is composed of an acrylic resin or the like (JP,A,2-150391, JP,A,5-185754).

The thermal transfer recording medium of the aforesaid structure wherein the protective layer is composed of an acrylic resin or the like provides printed images having high durability. However, the recording medium is poor in transferability, particularly one-dot reproducibility, causing a problem that clear fine lines cannot be obtained in printing bar codes.

In view of the aforesaid problem of the prior art, it is an object of the present invention is to provide a thermal transfer recording medium which has excellent transferability, particularly one-dot reproducibility and is capable of producing printed images having high durability.

This and other objects of the present invention will become apparent from the description hereinafter.

SUMMARY OF THE INVENTION

The present invention provides a thermal transfer recording medium comprising a foundation, and a release layer, a protective layer and a colored ink layer provided on the foundation in this order, the protective layer comprising an acrylic resin and a diallyl phthalate resin.

According to an embodiment of the present invention, the ratio of the acrylic resin to the diallyl phthalate resin is from 95:5 to 70:30 by weight.

According to another embodiment of the present invention, the acrylic resin has a glass transition point of not lower than 80° C.

According to still another embodiment of the present invention, the acrylic resin comprises a polyalkyl methacrylate having a number average molecular weight of $10\times10^3$ to $50\times10^4$.

According to a further embodiment of the present invention, the diallyl phthalate resin comprises a prepolymer of at least one diallyl phthalate monomer selected from the group consisting of diallyl phthalate, diallyl isophthalate and diallyl terephthalate.

According to a still further embodiment of the present invention the diallyl phthalate resin has a weight average molecular weight of $20\times10^3$ to $65\times10^3$ and a softening point of 55° to 125° C.

DETAILED DESCRIPTION

The thermal transfer recording medium of the present invention is characterized in that the protective layer is composed of an acrylic resin and a diallyl phthalate resin as main components.

By virtue of the combination use of an acrylic resin and a diallyl phthalate resin in the protective layer, the thermal transfer recording medium of the present invention provides such superior results that the recording medium has excellent transferability, particularly one-dot reproducibility and can produce printed images having high durability such as scratch resistance and solvent resistance. Thus, the thermal transfer recording medium of the present invention is useful for forming bar codes and the like.

In order to obtain the aforesaid superior results, the ratio of the acrylic resin to the diallyl phthalate resin is preferably from 95:5 to 70:30 (by weight, hereinafter the same). When the proportion of the diallyl phthalate resin is smaller than 95/5, the transferability, particularly one-dot reproducibility is prone to be degraded, resulting in printed images with poor clearness. When the proportion of the diallyl phthalate resin is larger than 70/30, the durability such as scratch resistance and solvent resistance is prone to be degraded.

The protective layer may be incorporated with other resins or the like. In order to obtain the aforesaid results, however, it is preferable that the total amount of the acrylic resin and the diallyl phthalate resin comprises not less than 80% by weight of the protective layer.

The acrylic resin used in the present invention is preferably those having a glass transition point of not lower than 80° C. from the viewpoint of the durability. Examples of such acrylic resins are homopolymers or copolymers of acrylic monomers such as alkyl (meth)acrylate and (meth) acrylic acid, and copolymers of one or more of the foregoing acrylic monomers and one or more of other monomers such as styrene, α-methylstyrene and acrylonitrile. Especially preferred acrylic resins are polyalkyl methacrylates which have a number average molecular weight of $10\times10^3$ to $50\times10^4$ and wherein the alkyl group contains 1 to 18 carbon atoms, particularly 1 to 4 carbon atoms. Examples of the alkyl group are methyl, ethyl, n-butyl, isobutyl and tert-butyl. These acrylic resins may be used either alone or in combination of two or more species thereof.

The diallyl phthalate resin used in the present invention are prepolymers of one or more diallyl phthalate monomers such as diallyl phthalate, diallyl isophthalate and diallyl terephthalate. Preferably the diallyl phthalate resin has a weight average molecular weight of $20\times10^3$ to $65\times10^3$ and a softening point of 55° to 125° C.

The protective layer can be formed by applying onto the release layer a coating liquid, which is prepared by dissolving or dispersing the aforesaid resins and optionally other additives into a suitable solvent (inclusive of water), followed by drying. The coating amount (coating amount after being dried, hereinafter the same) of the protective layer is preferably from 0.3 to 1.3 g/m$^2$ from the veiwpoint of the protective effect and transferability.

The colored ink layer used in the present invention is not particularly limited. Conventional colored ink layers comprising a coloring agent and a thermally transferable vehicle as main components can be used. Colored ink layers wherein the thermally transferable vehicle is composed of a thermoplastic resin as a main component are preferable for use in forming printed images for bar codes.

As the coloring agent, there can be suitably used a variety of inorganic or organic pigments and dyes conventionally used as the coloring agent for thermally transferable ink, typically carbon black, and magnetic powders, metal powders and fluorescent pigments and dyes. The content of the coloring agent in the colored ink layer is preferably from about 5 to about 60% by weight.

As the aforesaid thermoplastic resin, there can be appropriately used one or more of polyester resins, acrylic resins, epoxy resins, phenol resins, ketone resins and polyethylene resins. From the viewpoint of the durability, thermoplastic resins having a glass transition point of not lower than 60° C. are preferably used.

The colored ink layer may be incorporated with body pigments and/or waxes, other additives such as dispersing agent and antistatic agent, as required. The coating amount of the colored ink layer is preferably from about 0.5 to about 3 g/m$^2$.

The release layer used in the present invention is preferably those comprising as a main component one or more waxes such as carnauba wax, paraffin wax and polyethylene wax. The release layer may be incorporated with resins, oils, body pigments and other additives, as required. The coating amount of the release layer is preferably from about 0.2 to about 1 g/m$^2$.

As the foundation in the present invention, there can be used a variety of plastic films generally used as a foundation film for ink ribbons of this type, typically polyethylene terephthalate film. The foundation preferably has a thickness of about 1 to about 10 $\mu$m. As required, a heat-resistant back layer (sticking-preventive layer) may be provided on the back side (the side to be contacted by a thermal head) of the foundation. The heat-resistant back layer is usually composed of one or more heat-resistant resins such as silicone-modified urethane resins and silicone-modified acrylic resins, or mixtures of the foregoing heat-resistant resins and lubricating agents.

Receptors on which printed images are formed with use of the thermal transfer recording medium of the present invention are not particularly limited. However, the effect of the present invention is markedly exerted when plastic films or sheets of polyethylene terephthalate, polyethylene naphthalate, or the like are used as the receptor.

The present invention will be described in detail by way of Examples and Comparative Examples. It is to be understood that the present invention will not be limited to these Examples, and various changes and modifications may be made in the invention without departing from the spirit and scope thereof.

EXAMPLES 1 TO 3 AND COMPARATIVE EXAMPLES 1 to 3

Onto one side of a 4.5 $\mu$m-thick polyethylene terephthalate film having a heat-resistant back layer formed on the other side thereof was applied and dried a coating liquid for release layer of the following formula to form a release layer with a coating amount of 0.5 g/m$^2$.

Coating liquid for release layer

| Component | Part by weight |
|---|---|
| Aqueous emulsion of carnauba wax (solid content: 20% by weight) | 50 |
| Water | 50 |

Onto the release layer was applied and dried a coating liquid for protective layer of the formula shown in Table 1 to form a protective layer with a coating amount of 0.7 g/m$^2$.

TABLE 1

| Component (part by weight) | Ex.1 | Ex.2 | Ex.3 | Com. Ex.1 | Com. Ex.2 | Com. Ex.3 |
|---|---|---|---|---|---|---|
| Acrylic resin*1 | 9 | 8 | 7 | 10 | 9.7 | 6.5 |
| Diallyl phthalate resin*2 | 1 | 2 | 3 | 0 | 0.3 | 3.5 |
| Methyl ethyl ketone | 40 | 40 | 40 | 40 | 40 | 40 |

*1Dianal BR80 made by Mitsubishi Rayon Co., Ltd., glass transition point: 105° C.
*2Dap A made by Diso Co., Ltd., softening point: 55° to 125° C.

Onto the protective layer was applied and dried a coating liquid for colored ink layer of the following formula to form a colored ink layer with a coating amount of 1.0 g/m$^2$, yeilding a thermla transfer recording medium.

Coating liquid for colored ink layer

| Component | Part by weight |
|---|---|
| Polyester resin (glass transition point: 70° C.) | 9 |
| Carbon black | 6 |
| Toluene | 85 |

Each of the thermal transfer recording media was used for printing. With respect to the obtained printed images, the transferability (one-dot reproducibility), scratch resistance and solvent resistance were evaluated by the following methods. The results are shown in Table 2.

The printing was conducted using a thermal transfer recording type bar code printer (B-474 made by TEC Corporation) under the following conditions.

Printing speed: 5 inches/second

Printing pattern: ANK, bar code, graphic pattern, and solid pattern

Receptor: 50 $\mu$m-thick polyethylene terephthalate film (1) Transferability (One-Dot Reproducibility)

The printed images were evaluated according to the following criteria.

A: Good printed images can be obtained for all of ANK, bar code, graphic pattern and solid pattern.

B: Good printed images can be obtained for ANK, bar code and solid pattern, but printed images with dropout portion and the like are obtained for graphic pattern.

C: Printed images in ANK are legible, but printed images in bar code are illegible.

D: Printed images in both ANK and bar code are illegible.

The evaluation values "A" and "B" indicate that the printed images are practically usable.

(2) Scratch Resistance

The same portion of the printed image in bar code (parallel bar code) was scratched 50 times with a pen scanner. The resulting images were evaluated according to the following criteria.

A: The image is not removed at all.

B: The image is little removed.

C: The image is a little removed.

D: The image is appreciably removed.

The evaluation values "A" and "B" indicate that the printed images are practically usable.

(3) Solvent Resistance

The same portion of the printed image in bar code (parallel bar code) was rubbed ten times with a swab (cotten stick) impregnated with a solvent shown in Table 2. The resulting images were evaluated according to the following criteria.

A: The image is not removed at all.

B: The image is little removed.

C: The image is a little removed.

D: The image is appreciably removed.

The evaluation values "A" and "B" indicate that the printed images are practically usable.

TABLE 2

| | Ex. 1 | Ex. 2 | Ex. 3 | Com. Ex.1 | Com. Ex.2 | Com. Ex.3 |
|---|---|---|---|---|---|---|
| Transferability | B | B | A | D | C | A |
| Scratch resistance | A | A | A | A | A | B |
| Solvent resistance | | | | | | |
| Kerosene | A | A | A | A | A | B |
| Gasoline | B | B | B | B | B | D |
| Ethanol | B | B | B | B | B | D |

The thermal transfer recording medium of the present invention provides with good transferability (one-dot reproducibility) printed images having high durability such as scratch resistance and solvent resistance.

In addition to the materials and ingredients used in the Examples, other materials and ingredients can be used in the Examples as set forth in the specification to obtain substantially the same results.

What is claimed is:

1. A thermal transfer recording medium comprising a foundation, and a release layer, a protective layer and a colored ink layer provided on the foundation in this order, the protective layer comprising an acrylic resin and a diallyl phthalate resin.

2. The thermal transfer recording medium of claim 1, wherein the ratio of the acrylic resin to the diallyl phthalate resin is from 95:5 to 70:30 by weight.

3. The thermal transfer recording medium of claim 1, wherein the acrylic resin has a glass transition point of not lower than 80° C.

4. The thermal transfer recording medium of claim 3, wherein the acrylic resin comprises a polyalkyl methacrylate having a number average molecular weight of $10\times10^3$ to $50\times10^4$.

5. The thermal transfer recording medium of claim 1, wherein the diallyl phthalate resin comprises a prepolymer of at least one diallyl phthalate monomer selected from the group consisting of diallyl phthalate, diallyl isophthalate and diallyl terephthalate.

6. The thermal transfer recording medium of claim 5, wherein the diallyl phthalate resin has a weight average molecular weight of $20\times10^3$ to $65\times10^3$ and a softening point of 55° to 125° C.

* * * * *

UNITED STATES PATENT AND TRADEMARK OFFICE

CERTIFICATE OF CORRECTION

PATENT NO : 5,968,668

DATED : October 19, 1999

INVENTION(S) : THERMAL TRANSFER RECORDING MEDIUM

It is certified that error appears in the above-identified patent and that said Letters Patent are hereby corrected as shown below:

Cover page, item [30] Foreign Application Priority Data insert -- Feb. 7, 1997 [JP] Japan 9-025571 --.
Cover page, item [57] Abstract, line 2; and column 6, line 3 delete first occurrence of "and".
Column 1, line 24 and column 3, line 10 delete "is".
Column 1, line 33 delete "and".
Column 1, line 53 delete "a still further" and substitute therefor -- yet another --.
Column 1, line 62 after "as" insert -- the --.
Column 1, line 64 delete "combination" and substitute therefor -- combined --.
Column 2, line 21 delete "those" and substitute therefor -- one --.
Column 2, line 22 delete "from the viewpoint of the" and substitute therefor -- to ensure --.
Column 2, line 47 delete "from the viewpoint of the" and substitute therefor -- to sustain adequate --.
Column 2, line 56 delete "there can be suitably used" and substitute therefor -- one can use --.
Column 2, line 67 delete "From the viewpoint of the" and substitute therefor -- For improved --.
Column 3, line 6 delete both occurrences of "agent" and substitute therefor -- agents --.
Column 3, line 11 delete "those comprising" and substitute therefor -- comprises --.
Column 3, line 18 delete "there can be" and substitute therefor -- one can use --.
Column 3, line 19 delete first occurrence of "used".
Column 3, line 32 delete "with use of" and substitute therefor -- using --.

UNITED STATES PATENT AND TRADEMARK OFFICE

CERTIFICATE OF CORRECTION

PATENT NO : 5,968,668

DATED : October 19, 1999

INVENTION(S) : THERMAL TRANSFER RECORDING MEDIUM

It is certified that error appears in the above-identified patent and that said Letters Patent are hereby corrected as shown below:

Column 3, line 35 delete "exerted" and substitute therefor -- enhanced --.
Column 4, line 16 delete "thermla" and substitute therefor -- thermal --.
Column 4, line 52 and line 64; and column 5, line 8 delete "practically usable." and substitute therefor -- usable in practice. --.
Column 4, line 59 and column 5, line 4 delete "little" and substitute therefor -- barely --.
Column 5, line 22 delete "with".
Column 5, line 23 after "reproducibility)" insert -- and --.
Column 5, line 27 delete "Examples" and substitute therefor -- present invention --.

Signed and Sealed this

Tenth Day of April, 2001

*Attest:*

Nicholas P. Godici

NICHOLAS P. GODICI

*Attesting Officer*

*Acting Director of the United States Patent and Trademark Office*